US006079650A

United States Patent [19]

Scaglia

[11] Patent Number: 6,079,650

[45] Date of Patent: Jun. 27, 2000

[54] HOOKS AND LOOP FASTENER ATTACHED TO A BOBBIN BY ULTRASONIC WELDING

[75] Inventor: Enzo Scaglia, Milan, Italy

[73] Assignee: Scaglia SpA, Brembill, Italy

[21] Appl. No.: 09/118,893

[22] Filed: Jul. 20, 1998

[30] Foreign Application Priority Data

Jul. 24, 1997 [IT] Italy ..... UD97A0133

[51] Int. Cl.[7] ..... B65H 75/28

[52] U.S. Cl. ..... 242/125.1

[58] Field of Search ..... 242/125.1, 118.32, 242/610.6, 610, 583; 156/73.1, 290, 308.4, 73.2, 73.4

[56] References Cited

U.S. PATENT DOCUMENTS

| | | | |
|---|---|---|---|
| 3,851,838 | 12/1974 | Biggs, Jr. et al. | 242/118.32 |
| 3,967,795 | 7/1976 | Shindo et al. | 242/125.1 |
| 4,427,485 | 1/1984 | Kutnyak et al. | 156/73.1 X |
| 4,842,213 | 6/1989 | Bartschi et al. | 242/125.1 |

FOREIGN PATENT DOCUMENTS

| | | |
|---|---|---|
| 208379 | 1/1987 | European Pat. Off. . |
| 542672 | 5/1993 | European Pat. Off. . |
| 2217252 | 9/1974 | France . |
| 681980 | 6/1993 | Switzerland . |

*Primary Examiner*—Donald P. Walsh
*Assistant Examiner*—Collin A. Webb
*Attorney, Agent, or Firm*—Antonelli, Terry, Stout & Kraus, LLP

[57] ABSTRACT

Method to attach an annular band (11) of adhesive material such as Velcro (hook and loop fastener), felt or similar material onto a substantially cylindrical support (10) onto which it is suitable to wind a product for example for spinning for example of the sliver type in which, the annular band (11) is attached to the support (10) by means of welding along at least one circumference. a substantially cylindrical support of the cop or spool type, onto which it is suitable to wind a product for spinning of the sliver type, includes an annular band onto which is attached a corresponding outer annular band (11) of substantially adhesive material, such as Velcro (hook and loop fastner), felt or similar material, the annular band (11) being attached to the support (10) by means of welding made along at least two circumferences arranged in proximity with the peripheral edges of the annular band (11).

17 Claims, 1 Drawing Sheet

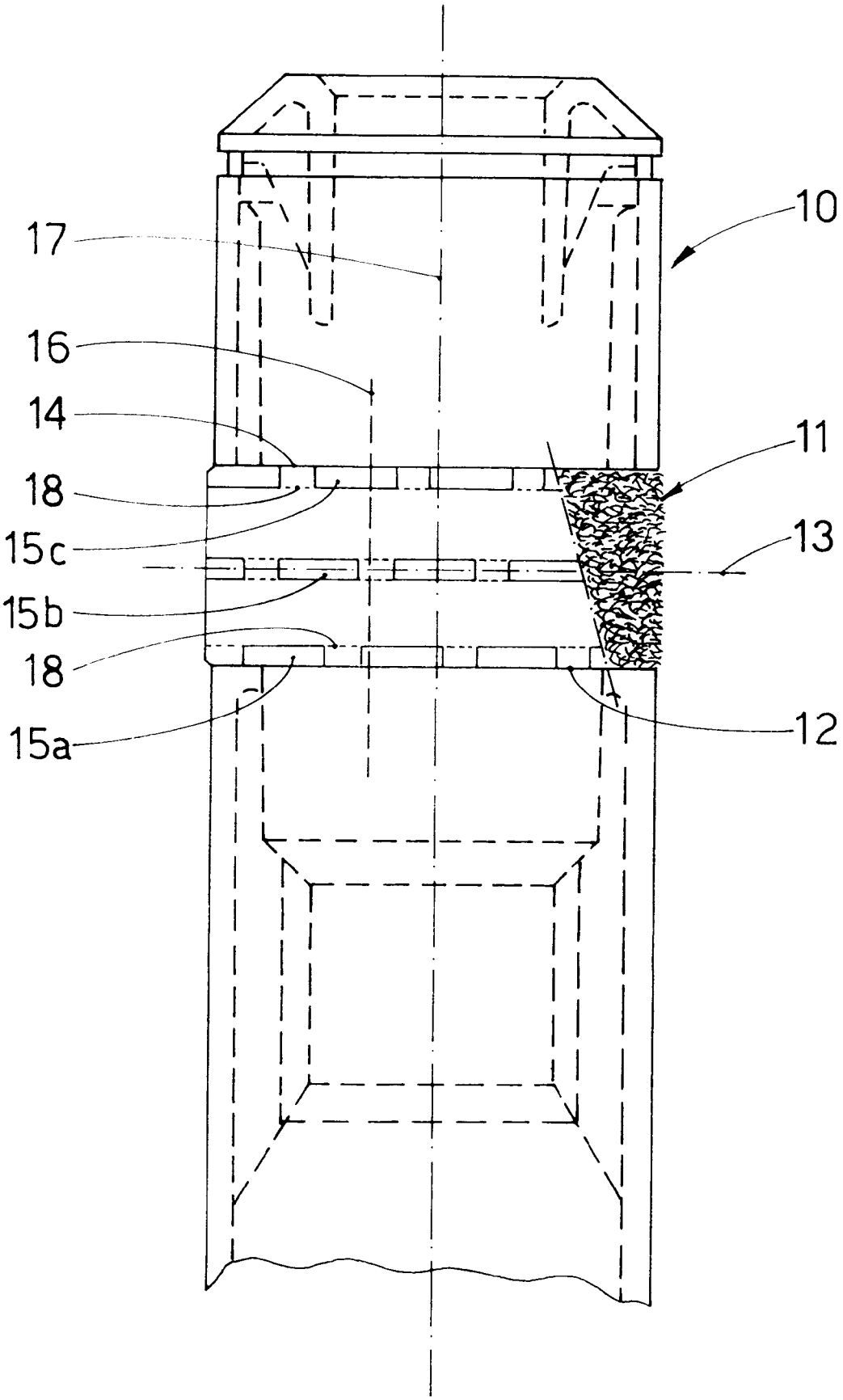
10
17
16
14
11
18
15c
13
15b
18
12
15a

HOOKS AND LOOP FASTENER ATTACHED TO A BOBBIN BY ULTRASONIC WELDING

FIELD OF THE INVENTION

This invention concerns a method to attach a band of special material onto a support for textile material and the relative support for textile material.

The invention is applied in the field of textiles on cylindrical supports, called cops or spools, onto which a product for spinning is wound, for example a sliver of fibres.

BACKGROUND OF THE INVENTION

In the field of textile production the state of the art includes the use of cylindrical supports, called cops or spools, onto which the product for spinning, such as a sliver of fibres, is wound.

Due to their lack of consistency, the leading ends of the sliver of fibres tend to detach themselves from the support so that winding is difficult and rather unstable.

In order to overcome these problems, CH-A-681.980 proposed to cover a circumferential segment of the support with an annular band of special material with high gripping characteristics, for example Velcro, felt or similar, to which the leading ends of the sliver anchor themselves and remain attached in a sufficiently stable manner.

The annular band of special material is attached to the support by means of a strip of adhesive material which is less wide than the annular band.

EP-A-0.208.379 discloses a collection strip formed by a strip of material whose surface consists by thorn-shaped elevations on the ends of which heads are applied in such a manner that the thread can remain caught while the support is rotating.

In more recent applications, the band is welded, by means of ultrasound, lengthwise or axially to the support in the join area, that is to say, in the area where the terminal ends of the band face each other, or it is both glued and welded.

In those cases where the remains of the sliver are removed manually after winding has been completed, this application does not cause any particular problems.

On the contrary, when automatic or semi-automatic methods are used, the last layer, or the remains of the sliver, is removed from the support by making a longitudinal cut on the layer of sliver; this can cause the fraying of the lips where the cut is made and the partial lifting and detachment of the band of special material from the support.

The subsequent operations of cleaning the support, performed for example by jets of air, may then cause a folding back or even a complete lifting of the lips; this practically makes the support no longer usable, except after long and laborious operations involving the complete removal of the band and the re-application of a new band.

The present applicants have designed, tested and embodied this invention to overcome the shortcomings of the state of the art with a simple, economical and extremely functional solution.

SUMMARY OF THE INVENTION

The purpose of the invention is to apply a band of special material, such as Velcro (hook and loop type fastner) or similar material, in a secure and stable manner onto a support for textile material so that, on removing the remaining textile material, generally in the form of a sliver of fibres which remains at the end of the winding, there is no displacement of the band, which might cause the band to bulge, open, lift and become detached.

The removal operation, whether it is performed manually or with automatic or semi-automatic means, is normally preceded by a cutting operation which concerns the periphery of the cop or spool in a longitudinal direction.

The band of special material is welded, in a manner known to the state of the art, in correspondence with its longitudinal line of join.

According to the invention, the band of special material is also welded onto the support along at least its circumference placed in correspondence or in proximity with the lower edge, that is to say the edge nearest the supporting base of the support.

In a first embodiment, the circumferential welding is performed at different points.

According to a variant, the welding is performed in a continuous manner along the whole circumference.

According to another variant, the band is welded, either continuously or at various points, in correspondence with the lower edge and the upper edge and, according to a further variant, also in correspondence with at least an intermediate circumference.

In this embodiment, according to the invention, in the case where welding is at different points, the points are staggered lengthwise in such a way that the cut made along a segment parallel to the longitudinal axis of the support meets one or more welding points where, even when the lengthwise cut has been made, the surround of the welding points remains sufficiently anchored to the support.

In this way the welding points made on the three circumferences are arranged along rectilinear segments arranged at an angle to the longitudinal axis of the support.

The welding points, moreover, are made in such a way that the circumferences are close together and therefore only short unwelded segments remain between them.

According to yet another variant, the annular band of special material is also glued to the support.

BRIEF DESCRIPTION OF THE DRAWING

The attached FIGURE is given as a non-restrictive example and shows in a preferential embodiment of the invention a part of a support for textile material adopting the solution according to the invention.

DETAILED DESCRIPTION OF THE PREFERRED EMBODIMENT

The cylindrical support 10 for textile material, partly shown in the attached FIGURE, is of the type commonly known as a "spool" and is suitable to wind thin yarns of limited consistency, such as for example slivers of fibres or similar material, into superimposed layers.

An annular band 11 made of special material suitable to anchor the leading ends of the threads, such as a band made of Velcro (hook and loop fastner), felt or similar material, as partly shown in the FIGURE, is applied to the support 10 in an upper area thereof.

According to the invention, the annular band 11 is not only welded lengthwise in its area of joining but is also attached to the support 10 by means of point welding along at least one circumference. The welding along the circumference affects a fraction of the height of the annular band 11; this fraction is contained in a value of between 1.5 and 3 mm.

According to a variant, indicated here by a line of dashes, the annular band 11 is welded along one circumference with a continuous welding 18 onto the support 10.

In the case shown in the FIGURE, the point welding is performed on three circumferences, a first circumference substantially coinciding with the lower edge 12 of the annular band 11, a second circumference substantially coinciding with the median zone 13 and a third circumference substantially coinciding with the upper edge 14 of the band 11.

According to a variant which is not shown here, the welding is performed on a plurality of intermediate circumferences between the lower edge 12 and the upper edge 14.

The welding points, respectively indicated by the reference number 15*a* for the lower edge 12, 15*b* for the median area 13 and 15*c* for the upper edge 14, are staggered in such a way that any segment 16 parallel to the longitudinal axis 17 of the cylindrical support 11 meets at least two of the welding points 15.

In this way the welding points made on the three circumferences are arranged along rectilinear segments arranged at an angle to the longitudinal axis of the support.

With this embodiment, any lengthwise cut made on the last layer or on the remains of the sliver, which also affects the annular band 11, does not cause the formation of cutting lips which tend to be opened and lifted by the subsequent processing operations on the support 10; on the contrary, any cut made meets welding points 15*a*, 15*b*, 15*c*, and the cutting lips around them remain substantially adherent to the support 10.

According to the system by which the sliver is removed, whether it be automatic or not, the circumference at the top or bottom will be preferentially welded. The intermediate circumference will be preferentially welded when the material which makes up the band tends to stretch and create swellings or deformations which modify the periphery of the support in an unacceptable manner.

I claim:

1. Method to attach an annular band of adhesive material onto a substantially cylindrical support onto which it is suitable to wind a product the method comprising welding the annular band to the support along at least one circumference.

2. Method as in claim 1, characterised in that the welding is made along at least two circumferences arranged in proximity with the peripheral edges of the annular band.

3. Method as in claim 2, characterised in that the welding is also made along at least a third circumference in an intermediate position between the two circumferences.

4. Method as in claim 2 characterised in that the welding is made at separate welding points.

5. Method as in claim 4, characterised in that the welding points made on the circumferences are arranged along rectilinear segments arranged at an angle to the longitudinal axis of the support.

6. Method as in claim 4, characterised in that the welding points made on the circumferences are staggered with respect to each other in such a manner that at least two of the welding points lie on any one peripheral segment of the outer annular band, parallel to the longitudinal axis of the support.

7. Method as in claim 1, characterised in that the welding is carried out in a continuous manner.

8. Substantially cylindrical support onto which it is suitable to wind a product for spinning the support including an annular band onto which is attached a corresponding outer annular band of substantially adhesive material, wherein the annular band is attached to the support by means of welding made along at least two circumferences arranged in proximity with the peripheral edges of the annular band.

9. Support as in claim 8, characterised in that the welding is achieved also along at least a third circumference at an intermediate position between the two circumferences.

10. Support as in claim 8, characterised in that the welding is achieved at separate points of welding.

11. Support as in claim 10, characterised in that the points of welding achieved on the circumferences are arranged along rectilinear segments arranged at an angle to the longitudinal axis (17) of the support (10).

12. Support as in claim 10, characterised in that the points of welding (15*a*, 15*b*, 15*c*) made on the circumferences are staggered with respect to each other in such a manner that at least two of the points of welding lie on any one peripheral segment of the outer annular band parallel to the longitudinal axis of the support.

13. Support as in claim 8, characterised in that the welding is carried out in a continuous manner.

14. Support as in claim 8, characterised in that the outer band has an outer surface comprising a felt material.

15. Support as in claim 8, characterised in that the outer annular band has an outer surface comprising a hook and loop fastener material.

16. Method as in claim 1, characterised in that the annular band has an outer surface comprising a felt material.

17. Method as in claim 1, characterised in that the annular band has an outer surface comprising a hook and loop fastener material.

* * * * *